US012440890B2

(12) United States Patent
Neumann et al.

(10) Patent No.: US 12,440,890 B2
(45) Date of Patent: Oct. 14, 2025

(54) APPARATUS AND METHOD FOR PRODUCING AND FURTHER PROCESSING OF SLABS

(71) Applicant: SMS group GmbH, Düsseldorf (DE)

(72) Inventors: Luc Neumann, Düsseldorf (DE); Frank Lensing, Krefeld (DE); Christoph Klein, Kreuztal (DE); Michael Pogrebinski, Wuppertal (DE); Björn Kintscher, Velbert (DE); Michael Pander, Cologne (DE)

(73) Assignee: SMS group GmbH, Düsseldorf (DE)

( * ) Notice: Subject to any disclaimer, the term of this patent is extended or adjusted under 35 U.S.C. 154(b) by 113 days.

(21) Appl. No.: 17/762,338

(22) PCT Filed: Sep. 21, 2020

(86) PCT No.: PCT/EP2020/076298
§ 371 (c)(1),
(2) Date: Mar. 21, 2022

(87) PCT Pub. No.: WO2021/058433
PCT Pub. Date: Apr. 1, 2021

(65) Prior Publication Data

US 2022/0339695 A1 Oct. 27, 2022

(30) Foreign Application Priority Data

Sep. 23, 2019 (DE) ..... 10 2019 214 451.9
Apr. 22, 2020 (DE) ..... 10 2020 205 077.5

(51) Int. Cl.
*B22D 11/16* (2006.01)
*B22D 11/12* (2006.01)
(Continued)

(52) U.S. Cl.
CPC ..... *B22D 11/163* (2013.01); *B22D 11/1206* (2013.01); *B22D 11/1213* (2013.01); *B22D 11/126* (2013.01); *B22D 11/142* (2013.01)

(58) Field of Classification Search
CPC . B22D 11/12; B22D 11/1206; B22D 11/1213; B22D 11/126; B22D 11/16; B21B 1/466
See application file for complete search history.

(56) References Cited

U.S. PATENT DOCUMENTS 5,276,952 A 1/1994 Thomas et al.
5,467,519 A 11/1995 Tippins et al.
(Continued)

FOREIGN PATENT DOCUMENTS

CN 1192171 A 9/1998
CN 101653779 A 2/2010
(Continued)

*Primary Examiner* — Keith Walker
*Assistant Examiner* — Jacky Yuen
(74) *Attorney, Agent, or Firm* — Smartpat PLC

(57) ABSTRACT

An apparatus for producing and further processing slabs of a metal, preferably steel, comprises: a continuous casting apparatus, which is designed to produce at least one cast strand and to transport it in a transport direction; a cutting device, which is arranged behind the continuous casting apparatus, as seen in the transport direction, and is designed to cut the cast strand into slabs; at least a first route and a second route, which implement, at least in some portions, different process lines for the further processing of the slabs; and a process control system, which is designed to make a route decision on a slab-specific basis as a function of at least one measured or calculated process parameter, which route decision assigns one of the plurality of routes to the respective slab, and to initiate the further processing of the corresponding slab along the assigned route.

15 Claims, 1 Drawing Sheet

(51) Int. Cl.
*B22D 11/126* (2006.01)
*B22D 11/14* (2006.01)

(56) References Cited

U.S. PATENT DOCUMENTS

| | | | | |
|---|---|---|---|---|
| 5,511,303 | A * | 4/1996 | Tippins | B21B 45/00 72/202 |
| 5,533,248 | A * | 7/1996 | Tippins | B21B 45/00 72/202 |
| 5,915,457 | A * | 6/1999 | Pleschiutschnigg | B21B 1/466 164/486 |
| 6,436,205 | B1 | 8/2002 | Behrens et al. | |
| 2006/0143897 | A1 | 7/2006 | Thomanek | |
| 2010/0147484 | A1 | 6/2010 | Rosenthal et al. | |
| 2012/0160377 | A1* | 6/2012 | Seidel | C21D 8/021 72/201 |
| 2014/0110079 | A1 | 4/2014 | Colombo et al. | |
| 2016/0243602 | A1 | 8/2016 | Benedetti et al. | |
| 2017/0002439 | A1 | 1/2017 | Benedetti et al. | |
| 2017/0298491 | A1 | 10/2017 | Toschi | |

FOREIGN PATENT DOCUMENTS

| | | | | |
|---|---|---|---|---|
| CN | 101848780 | A | 9/2010 | |
| CN | 102802839 | A | 11/2012 | |
| CN | 105492140 | A | 4/2016 | |
| CN | 105792954 | A | 7/2016 | |
| EP | 0662358 | A1 | 7/1995 | |
| EP | 0726101 | A1 | 8/1996 | |
| EP | 0808672 | B1 | 12/2001 | |
| EP | 1980345 | B1 | 10/2008 | |
| EP | 2535125 | A2 | 12/2012 | |
| JP | 57187102 | A * | 11/1982 | B21B 1/466 |
| JP | H0381012 | A | 4/1991 | |
| WO | 9323182 | A1 | 11/1993 | |
| WO | 2004069440 | A1 | 8/2004 | |
| WO | 2009027045 | A1 | 3/2009 | |

* cited by examiner

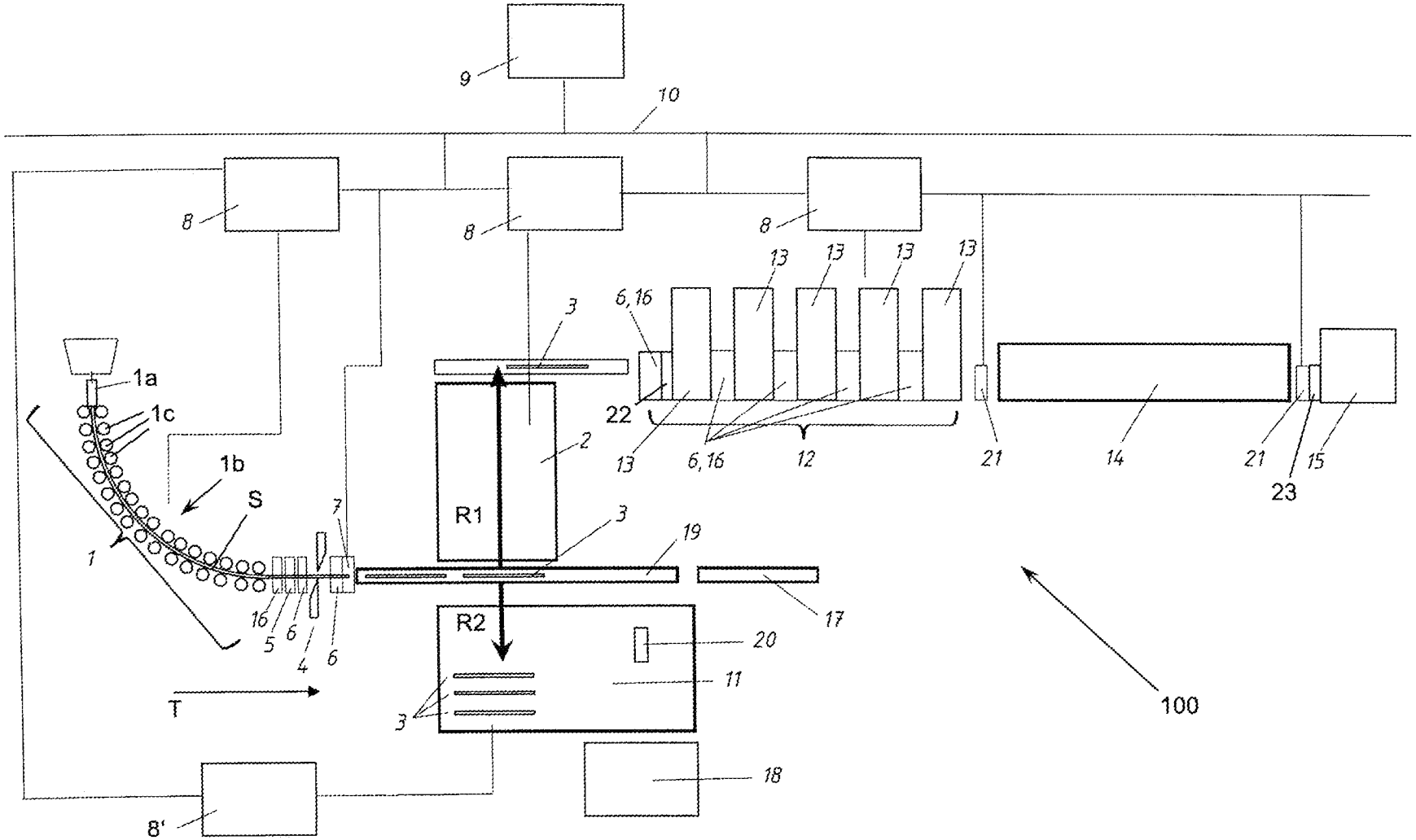
100
15
23
21
14
21
13
13
13
13
12
8
6, 16
6, 16
22
13
10
9
8
3
2
R1
3
19
17
20
11
18
R2
3
8
7
6
4
6
5
16
S
1b
1a
1c
1
T
8'

APPARATUS AND METHOD FOR PRODUCING AND FURTHER PROCESSING OF SLABS

TECHNICAL FIELD

The disclosure relates to an apparatus and a method for the production and further processing of slabs of a metal, preferably steel. The apparatus comprises a continuous casting apparatus for producing a cast strand and a cutting device for cutting the cast strand into slabs.

BACKGROUND

In continuous casting, a continuous casting process for the production of semi-finished products such as slabs and sheets made of ferrous and non-ferrous alloys, the metal is poured through a usually cooled ingot mold and discharged with a solidified shell and usually still liquid core downwards, sideways or in an arc.

The technical structure and requirements of continuous casting apparatuses differ considerably depending on whether they are designed to produce so-called "thin slabs" in a thickness range of approximately 40 to 110 mm, "medium slabs" in a thickness range of approximately 110 to 200 mm, or "thick slabs" with greater thicknesses.

Casting machines for the production of medium slabs feature ingot molds with typically plane-parallel plates (starting at approximately 140 mm thickness) for primary shaping and primary cooling, which simplifies the casting of some steel grades compared with the funnel-shaped ingot molds of thin-slab casting machines. Such steel grades include peritectic-transforming and other crack-critical steel grades. These have the special feature that the strand shell, which has already solidified in the ingot mold but is still thin, undergoes a volume jump (shrinkage of approximately 0.5%) due to a phase transformation (from delta ferrite to austenite). This creates tensile stresses that can lead to cracks and perforations more frequently than with other steel grades. Therefore, peritectic or other crack-sensitive steel grades are difficult to cast reliably and with high quality on thin slab plants with a funnel ingot mold.

The ingot mold plates are typically made of copper. The so-called "metallurgical length" of the casting machine is mostly between 10 and 35 m. The casting machine can be equipped with "liquid core reduction" (LCR) or "dynamic soft reduction" (DSR), that is, techniques that reduce the thickness of the cast strand by utilizing the still liquid core (in the case of LCR) or soft core (in the case of DSR) and by positioning strand guide elements outside the ingot mold. The casting machine can further be preceded by any steel-making plant for the preparation and delivery of molten steel, comprising, for example, an electric arc furnace ("EAF") or using a basic oxygen furnace ("BOF") with optional vacuum and/or ladle processing.

In the case of casting machines for the production of medium slabs, these are currently separated from the cast strand by one or more flame-cutting machines, for example with a slab length of less than 30 m, preferably less than 20 m. This produces a so-called "burr" on the front and rear end faces of the medium slabs as seen in the casting direction. To protect downstream tools, transporting or shaping devices, such as roller tables or work rollers of a rolling mill, the burrs produced by flame cutting must be removed. Removal is usually done with mechanical methods and equipment.

Subsequently, the medium slabs are usually marked or stamped before being temporarily stored in a slab storage facility. There, they are cooled to a temperature in the range of between ambient temperature and 600° C. before being fed as required to a walking beam furnace, which heats the medium slabs to forming temperature, approximately 1,000° C. to 1,300° C., possibly with upstream heating units.

The medium slabs heated in this manner are then formed in a forming unit, typically a rolling mill, which can be equipped with one or more descaling devices. The rolling mill can be operated in reversing mode with one or more stands or in tandem. A combination of optionally reversing roughing stands and a finishing line with intermediate heating and cooling apparatuses can also be used. The one or more forming units are followed by a cooling section, a discharge device and/or one or more coiling units.

As mentioned above, the medium slabs are temporarily stored and cooled in a slab storage facility before being heated to forming temperature, since, on the one hand, the processes were never planned to be coupled historically and, on the other hand, for technological reasons, some steel grades cannot be inserted into the walking beam furnace in the surface temperature range of between 850° C. and 600° C. Therefore, the resulting temperature loss must be fully compensated by the walking beam furnace.

The process control comprises actuators and sensors, but is based only on simple process models, which places strong limits on making the process more flexible, increasing efficiency and saving resources.

SUMMARY

One object of the disclosure is to provide an improved apparatus along with an improved method for the production and further processing of slabs of a metal, preferably steel, in particular to overcome one or more of the disadvantages set forth above.

The task is solved by an apparatus with the features as claimed and by a method with the features of the independent method claim. Advantageous further embodiments follow from the subclaims, the following description of the invention and the description of preferred exemplary embodiments.

The apparatus is used for the production and further processing, in particular the forming, of slabs as semi-finished products in the metallurgical field. In this process, slabs are cast from a metal, in particular a metal alloy, preferably steel.

The apparatus is particularly preferably designed for the production and further processing of medium slabs. Medium slabs include slabs with a thickness in the range of 110 to 200 mm, in particular 140 to 200 mm. In the latter case, an ingot mold with two opposite broad sides and two opposite narrow sides can be applied in the continuous casting apparatus, each of which, or at least with respect to the slab thickness, is formed by plane-parallel plates, preferably made of copper or a copper alloy, which may be coated. With such an ingot mold structure, the casting quality of comparatively thick strand-shaped products from approximately 140 mm thickness and/or peritectically transforming or other crack-critical steel grades can be improved.

The apparatus comprises at least one continuous casting apparatus that is designed to produce at least one cast strand and to transport it in a transport direction.

The "transport direction" is the direction along which the casting strand and the slabs produced from it are conveyed in the process line. It should be noted that the transport direction does not have to denote a constant direction vector, but can depend on the strand or slab position, as the case may be, along the process line. For example, in the case of a vertical bending plant, the transport direction of the casting strand is initially directed vertically downwards and is then deflected along an arc into the horizontal.

Designations of a spatial relationship, such as "vertical," "horizontal," "above," "below," "upstream," "downstream," "in front of," "behind," etc., are clearly defined by the structure and intended use of the apparatus along with the transport direction of the casting strand or slabs, as the case may be.

The apparatus further comprises a cutting device that is arranged behind the continuous casting apparatus, when viewed in the transport direction, and is designed to divide or cut, as the case may be, the cast strand into slabs. Preferably, the cutting device comprises or is implemented by a shear. In this preferred case, the cast strand is thus not cut by means of a flame-cutting machine, which means that a deburring device for smoothing the slab faces can be dispensed with. The cutting device can comprise a compression device that is designed to sharpen the end face of the slab just created by the cut. Such a compression function can simplify the further processing of the slab, in particular gripping during forming in a forming unit.

The apparatus comprises a plurality of routes, that is, at least a first route and a second route, which implement, at least in some portions, different process lines for further processing of the slabs. For this purpose, the apparatus further comprises a process control system, which is designed to make a route decision for each individual slab as a function of at least one measured or calculated process parameter, which route decision assigns one of the plurality of routes to the respective slab, and to initiate the further processing of the corresponding slab along the assigned route.

In other words, a physical or imaginary branching, which guides the slabs to different routes of further processing as a function of the route decision made by the process control system, is behind the cutting device. The transport paths of the different routes can be at least partially physically separated; however, in certain embodiments, it may be sufficient for the slabs to be processed differently along a common transport path depending on the route decision. The different routes can meet again in the further course the process line, that is, they can be brought together again for joint further processing of the slabs.

By making an automated decision on the further route of the respective slab directly after cutting the casting strand, further processing can be made more flexible. For example, depending on quality, alloy, temperature, etc., slabs can be processed differently in the same plant and configuration. In doing so, the planned end application can play a special role, for example with regard to surface quality or degrees of forming for the deep drawing of sheets to be produced from the corresponding slab. For example, particularly high demands are usually placed on surface quality for automotive outer skin. Similarly, high demands are placed on Si alloyed grades for electrical sheet production. The process outlined here with route branching enables the separate processing of slabs of different end uses, grades, quality characteristics and the like at an early stage in an automated manner, thus minimizing scrap and increasing plant efficiency.

Preferably, the apparatus comprises a furnace that is arranged behind the cutting device, when viewed in the transport direction, and is designed to heat the slabs to a forming temperature. As used herein, "forming temperature" means a temperature required or suitable for forming the slabs in a forming unit, preferably by work rollers in a rolling mill. Preferably, the forming temperature is in the range of 1,000° C. to 1,300° C.

Preferably, the furnace is a walking beam furnace that is designed to lift the slabs vertically during heating. For this purpose, the walking beam furnace can have fixed beams and walking beams, a lifting drive and heating means. This design allows the apparatus to be particularly compact in terms of mechanical engineering.

Preferably, one of the routes, which for the sake of linguistic distinction shall be referred to hereinafter as the "first route," is designed to insert the corresponding slab into the furnace substantially directly after cutting by the cutting device. In accordance with this particularly preferred embodiment, the aim is to keep the cooling of the slab (following the intended cooling of the cast strand by primary and secondary cooling in the continuous casting apparatus) as low as possible.

Starting from the production of the cast strand in an exemplary continuous casting apparatus, the strand, which has not yet solidified through, emerges from the ingot mold, is then initially further guided downward by means of a strand guide, and is then deflected into the horizontal in a bending region, while heat is intentionally extracted from it in the segments of the strand guide and thereafter, such that it cools and solidifies successively from the outside inward. The casting strand is subsequently cut into slabs by the cutting device. Before entering the furnace, the slabs on the first route have cooled to a temperature below the forming temperature, wherein such temperature loss is kept as low as possible.

For example, the first route can be designed to insert the corresponding slabs into the furnace at a temperature of 600° C. or more, preferably 850° C. or more.

By designing the first route in the manner described, cooling to a lower temperature range can be avoided and it is possible to heat the slabs directly to forming temperature. A slab storage facility can be eliminated on this route or designed overall in the plant with significantly less storage capacity, since major reasons for its use are obsolete. The furnace can be designed to be compact and particularly energy efficient. Overall, this results in a compact plant that enables the energy-saving, resource-conserving and cost-effective production of metallurgical products. It also favors the production of, in particular, peritectic-transforming or crack-critical steel grades, microalloyed steel grades, steel grades for pipeline production and steel grades with high surface quality requirements (e.g., for use as an outer skin for automobiles).

In order to design the first route in the manner described, it is possible to dispense with installing apparatuses for handling the slabs (excluding transport means such as a roller table, any inspection systems and heating apparatuses) between the cutting device and the furnace. It is particularly preferable to dispense with a deburring device behind the cutting device.

If, as a result of intentional or the unintentional cooling of slabs of certain steel grades, in particular microalloyed steel grades, it is not possible to use them in the furnace due to expected quality defects in the surface temperature range of below 600° C. or above 850° C., such slabs can, for example, be temporarily stored in a slab storage facility and preheated (during storage and/or during and/or after removal from the slab storage facility) by means of a heating device to a surface temperature of preferably 850° C. or more. Alternatively, such slabs can also be brought to a surface temperature below 600° C. by quenching/intensive cooling, such that they can still be used directly. During such cooling process, the microstructure layer near the surface transforms once (austenite—ferrite), and when the layer near the surface is reheated by thermal energy stored in the core, it transforms a second time (ferrite—austenite). This double conversion results in grain refinement (increase in grain boundary area) in the corresponding layer, thereby reducing the concentration of large elements or compounds (e.g., nitrides or carbides), which are precipitated on the grain boundaries. In higher concentrations, such elements or compounds would promote the formation of cracks in subsequent process stages. In addition, slabs can also be fed in a targeted manner to the slab storage facility, so that they can be inspected and, if necessary, processed with any inspection and/or processing equipment present there before they are then fed to the furnace after optional preheating in a heating device.

For this purpose, one of the routes, which for the sake of linguistic distinction shall be referred to hereinafter as the "second route," is designed to feed the corresponding slabs to a slab storage facility for intermediate storage after cutting by the cutting device. This allows the slabs to be processed particularly flexibly and individually. For example, slabs that are to be temporarily stored in the slab storage facility, for example on the basis of quality decisions made by means of one or more inspection systems, can be fed into the slab storage facility via a roller table, while subsequent slabs from the continuous casting apparatus can be transported unimpeded into the furnace. Furthermore, there is the possibility to process the slabs in the slab storage facility for high quality requirements. Such processing steps can be, for example, grinding, milling or scarfing.

Preferably, the second route is designed so that the corresponding slabs are discharged in front of the furnace, allowing the furnace to be fed simultaneously from the other side, that is, with slabs from other sources, preferably from the slab storage facility itself. Alternatively, the second route can be designed to guide the corresponding slabs past the furnace, preferably via a roller table, such that subsequent slabs from the continuous casting apparatus can be introduced into the furnace unimpeded via the first route.

One of the plurality of routes can be designed to eject the corresponding slabs after they have been cut by the cutting device. For example, slabs of certain properties can be diverted for direct purchase by a customer, for special finishing and the like.

Preferably, the apparatus comprises a heating device that is designed to preheat slabs that have undergone cooling in the slab storage facility or otherwise to a temperature of 600° C. or more, preferably 850° C. or more. The heating device can be part of the slab storage facility or arranged outside of it, and it ensures that a slab storage facility can be readily integrated without requiring the furnace to be larger in size or to handle different input temperatures of the slabs.

Preferably, the apparatus has a forming unit that is arranged behind the furnace in the process line, as seen in the transport direction. Particularly preferably, the forming unit is a rolling mill with one or more rolling stands. The rolling mill can be operated in reversing mode with one or more stands or in tandem. A combination of optional reversing roughing stands and a finishing line with intermediate heating and cooling apparatuses is also applicable. The forming unit is preferably followed by a cooling section, a discharge device and/or one or more coiling units. The forming unit preferably has one or more descaling devices.

By integrating the forming unit, slab casting and forming can be combined in terms of space and time. Such a "hybrid" processing was not previously possible, in particular for medium slab casting.

Preferably, the forming unit comprises one or more heating apparatuses, by which a constant/homogeneous temperature can be set along the length of the workpiece.

Preferably, the forming unit comprises a welding device for welding together individual workpieces, such as slabs or intermediate strips, by which forming can be performed on a continuous workpiece. In the case of a rolling mill, for example, the welding device can be installed before or in front of the last stand group. This allows individual, successive slabs or intermediate strips, as the case may be, to be rolled endlessly. Strip rolled in this manner can, if necessary, be separated again by a high-speed shear ("flying shear") in front of a coiling device.

The route decision is made by the process control system based, for example, on one or more of the following measured or calculated process parameters: Temperature of the slab, metallurgical properties of the slab, for example alloy (chemical analysis, steel grade), quality of the slab, preferably surface finish, planned end use.

Suitable inspection systems, comprising for example temperature sensors, cameras and/or other sensors, can be installed at one or more points along the process path to record the desired process parameters. Such values can also be provided online by suitable, preferably computer-based process models. Preferably, the cutting device itself comprises an inspection system, or an inspection system is arranged substantially directly behind the cutting device. The inspection system is communicatively coupled (wireless or wired) to the process control system and is designed to detect one or more physical quantities of the slabs and transmit them to the process control system, wherein the process control system is designed to use the data received from the inspection system to make route decisions.

For the route decision, the process planning system can take customer requests into account. Thus, a slab meeting special quality requirements can be discharged to the slab storage facility or for direct purchase by the customer. In doing so, the planned end application can play a special role, for example with regard to surface quality or degree of forming for the deep drawing of sheets to be produced from the corresponding slab. For example, particularly high demands are usually placed on surface quality for automotive outer skin. Similarly, high demands are placed on Si alloyed grades for electrical sheet production (for example, E strip with Si contents greater than 3% and Al contents greater than 0.3%). The process outlined here with route branching enables the separate processing of slabs of different grades and quality characteristics, in particular surface qualities, in an automated manner at an early stage.

Preferably, the apparatus comprises one or more heating apparatuses that are arranged upstream of the cutting device or of any decoupler and/or downstream of the cutting device. Preferably, a heating apparatus is arranged directly upstream of the cutting device or any decoupler and/or a heating apparatus is arranged directly downstream of the cutting device. In this connection, "directly" means that, apart from any means of transport, such as a roller table, there are no stations for handling the cast strand or slabs in between. The suitable installation of heating apparatuses can counteract the rapid cooling of the cast strand or slabs in an energy-saving manner, allowing the slabs to be inserted into the furnace at a comparatively high temperature and supporting the associated technical effects. The heating apparatus(es) can be inductive, gas burners and/or electric.

Preferably, the cutting device is a pendulum shear or other shear that is suitable for cutting the casting strand in motion, by which the casting strand can be cut into slabs without the need to rework the regions of the cut surfaces to protect subsequent tools of the process line and without the need to reduce the casting speed (significantly) for the cut. By not requiring a deburring device or an alternative apparatus for finishing the slabs in the region of the cut surfaces by using such a shear, the temperature loss of the slabs can be minimized.

In accordance with a preferred exemplary embodiment, the apparatus comprises an electronic warehouse management system that is designed to automatically record measured or calculated process parameters of the slabs in the slab storage facility, for example their positions along with process parameters and quality characteristics. The recorded measured or calculated process parameters can be linked and/or processed for various purposes, for example to automatically identify a suitable slab according to the specifications of a process planning system and to feed it to the process line.

Preferably, the apparatus comprises an electronic process planning system, which is designed to automatically record, store and process process parameters of the slabs and to control the production process. For example, the apparatus can have one or more electronic process control systems, such as so-called "Level 1" and "Level 2" systems. Process control systems, for example, for controlling molten steel production, the continuous casting apparatus, slab logistics, the upstream heating device, the furnace, a forming unit (such as a rolling mill and/or a cooling section) and/or the conveying devices for transporting the slabs, plates and/or strips can be networked with each other and/or with a process planning system ("Level 3") by means of a network. Process planning and process control can optionally be provided with cross-process automation, for example, in order to reduce energy consumption while at the same time optimizing process control in terms of technology and energy, and/or to minimize the throughput time of the products and/or to improve product quality.

Preferably, the apparatus comprises a process planning system, which includes at least one quality model, which is coupled to a decision process for route determination, such that a continuous casting and rolling operation or at least one continuous rolling operation can be maintained at any time, in order to utilize the apparatus in the best possible and energy-saving manner in terms of maximum production. This also includes the fact that, in the event of a planned or unplanned stoppage of the continuous casting apparatus, slabs can be fed to the furnace from the slab storage facility or from an external source (cold or, if necessary, with preheating in a further heating device contained in the apparatus) and subsequently formed, preferably rolled.

The task set forth above is further solved by a method for the production and further processing of slabs of a metal, preferably steel, wherein the method comprises: Producing and transporting a cast strand along a transport direction by means of a continuous casting apparatus; cutting the cast strand into slabs by means of a cutting device that is arranged behind the continuous casting apparatus, as seen in the transport direction; carrying out an individual route decision as a function of at least one measured or calculated process parameter, which assigns one of a plurality of routes to the respective slab; and further processing the corresponding slab along the assigned route.

The technical effects, advantages along with preferred embodiments described with respect to the apparatus apply analogously to the method.

Thus, after cutting, the slabs that are further processed along a first route are preferably arranged in a furnace arranged behind the cutting device, as seen in the transport direction, in order to heat the corresponding slabs to a forming temperature that is suitable for forming the slabs in a forming unit, preferably a rolling mill. The forming temperature is preferably in the range of 1,000° C. to 1,300° C.

Preferably, the slabs of the first route are inserted into the furnace substantially directly after cutting; in particular, the slabs are inserted into the furnace at a temperature of 600° C. or more, preferably 850° C. or more.

Preferably, the slabs that are further processed along a second route are fed to a slab storage facility for intermediate storage after being cut by the cutting device.

Further advantages and features of the present invention are apparent from the following description of preferred exemplary embodiments. The features described therein can be implemented alone or in combination with one or more of the features set forth above, provided the features do not contradict each other. The following description of the preferred exemplary embodiments is made with reference to the accompanying drawing.

Compared to the state of the art of the known thin slab technology, the proposed apparatuses or plants, as the case may be, and methods are particularly well suited to produce strips with high requirements on the final surface quality. These include fine and ultra-fine sheets with the highest optical or magnetic requirements, that is:

- Automotive outer skin (strips with good to excellent deep-drawing properties in accordance with Erichsen/Olsen in accordance with ISO 20482/ASTM E643-84) →(e.g., Erichsen cupping >8 mm for 0.5 mm sheet thickness or >9 mm for 1.0 mm sheet thickness)
- White goods or the like (ribbons for decorative, optical applications)
- Strips made of stainless steel with mirrored surfaces
- Silicon steels for electromobility with a silicon content of between [1 and 6%], {2 and 4%}, (2.4 and 3.6%) and an aluminum content or [less than 6%] {less than 3%}, (less than 1.5%) with special magnetic properties in accordance with DIN EN 60404-2:2009-01, e.g. for grain-oriented transformer sheets: Iron losses in the sheet package <1.2 W/kg at J=1.7 T magnetic polarization, 50 Hz frequency and 0.3 mm sheet thickness.

Raising the casting thickness to values of between {110 mm and 220 mm}, (140 mm and 200 mm) results in fewer or less pronounced casting defects near the surface per strip length compared with the state of the art in the casting process. In addition, the material is stretched more in the rolling process, such that less pronounced casting defects disappear visually. Under certain circumstances, it may be possible to dispense with the calcium processing of aluminum-killed carbon steels commonly used in thin-slab casting to convert the alumina inclusions into calcium aluminates—in order to improve castability. This improves the deep-drawing properties, since calcium aluminates have virtually no forming capacity whatsoever.

For the steel strip applications mentioned, it is also essential that the slabs are not damaged during transport to the hot rolling mill. Plants and processes that use tunnel furnaces to transport the slabs have a systemic disadvantage here. The tunnel furnaces, usually gas-fired, have lengths of between 50 and 350 m and are operated with low excess oxygen ($1<\lambda<1.3$) $\{1.02<\lambda<1.2\}$ in the temperature range of between 1000 and 1285° C. The slabs are transported by means of solid furnace rollers or furnace rollers with support rings from the region of the casting machine in line or laterally with the aid of ferries in front of the rolling mill.

The underside contact of the slabs with the rollers or support rings, as the case may be, can damage the underside of the slabs. The problem is known from the operation of the plants in accordance with the prior art. In the process, small cakings form on the furnace rollers as a result of many scale layers from the slab base material sticking together—occasionally also with the involvement of components from the casting powder ($SiO_2$, CaO, $CaF_2$), etc. Such cakings press into the slab surface with each revolution of the roller and damage it to such an extent that an oxide shell is formed in the strip during the subsequent rolling process. In particular, the use of long tunnel furnaces is unfavorable, as these increase the formation of scales and, with the increase in furnace length, there are correspondingly more roller contacts.

The effect is particularly pronounced under the following conditions:

1. For furnace temperatures above 1100° C. and steels whose scale has adhesive properties. The best-known representative of adhesive scale is fayalite "2(FeO) *$SiO_2$," which, as a binary compound in accordance with the state diagram, already forms a liquid eutectic together with wüstite "FeO" at a temperature of approximately 1175° C. Low contents of $Al_2O_3$ further lower the eutectic temperature and thus favor the formation of the adhesive scale. Accordingly, silicon steels with a silicon content of between 2 and 6% and an aluminum content of less than 6%, which are of particular importance for electromobility or the construction of transformers, are susceptible. The oxide shells formed in the strip reduce the magnetic properties of the silicon strips to such an extent that installation in a generator, motor or transformer, as the case may be, is ruled out.
2. For steels that have a ferritic microstructure in the temperature range of the furnace. The ferrite is significantly softer than the austenite, such that the indentations in the slabs form particularly easily and particularly deeply due to the roller contact. These include the ferritic Si steels with a silicon content of between 2 and 6% and the ferritic stainless steels (ASTM/AISI 400 series steel grades, e.g. Nirosta).
3. For steels that, due to the downstream rolling program, require a high slab exit temperature of >1150° C. to achieve the material properties in the rolling mill. With increasing temperature, the strength of the material generally decreases, such that the indentations in the slabs form particularly easily due to roller contact. In addition to the steels already mentioned, this also applies to the group of steels with low carbon contents, which are typically used in the automotive outer skin area or in the "white goods" sector. The oxide shells formed in the strip cannot be removed and are still visible after painting. The oxide-shelled material is unsuitable for the intended application.

The proposed plant or method, as the case may be, dispenses with the use of a tunnel furnace with furnace rollers. A walking beam furnace is used, that is, the slabs are transported further by lifting, which minimizes damage to the slabs on the underside.

BRIEF DESCRIPTION OF THE DRAWINGS

FIG. 1 schematically shows an apparatus for the production, further processing and forming of slabs.

DETAILED DESCRIPTION

Preferred exemplary embodiments are described below with reference to the figure. In this context, identical, similar or similarly acting elements are provided with identical reference signs, and a repetitive description of such elements is partially omitted in order to avoid redundancy.

FIG. 1 schematically shows an apparatus 100 for the production and further processing of slabs 3. The slabs 3 are preferably medium slabs, that is, slabs with a thickness in the range of approximately 110 to 200 mm, preferably 140 to 200 mm.

The apparatus 100 comprises one or more continuous casting apparatuses 1, which in the present exemplary embodiment is implemented as a vertical bending plant. However, the continuous casting apparatus 1 can be implemented in other manners as long as it provides a casting strand that can be subsequently cut into slabs and further processed.

The molten metal to be cast is fed to an ingot mold 1*a* of the continuous casting apparatus 1, for example from a casting ladle. The ingot mold 1*a* brings the molten metal into the desired slab shape as it solidifies gradually from the outside inward through the cooled ingot mold walls. The ingot mold 1*a* is preferably an ingot mold made of copper plates (or plates of a copper alloy, which may be coated), in the case of medium slabs with plane-parallel plates on the broad sides and narrow sides, which are adapted for a comparatively high casting thickness of, for example, 140 mm or more. If required by the casting thickness or casting radius, the copper plates can have a funnel-shaped contour and/or be curved in a transport direction T corresponding to the casting radius of a strand guide 1*b*.

The casting strand S, which has not yet solidified, emerges downward from the ingot mold 1*a*, then continues to be guided downward in the transport direction T along the strand guide 1*b*, and then is deflected into the horizontal in a bending region while it gradually cools down. It should be noted that the transport direction T does not denote a constant direction vector, but may depend on the strand or slab position, as the case may be, along the apparatus 100.

The strand guide 1*b* comprises rollers 1*c* that transport the cast strand S and can be adjusted for thickness reduction in accordance with LCR or DSR in such a manner that the transport gap in which the cast strand is transported along the transport direction T gradually narrows. The strand guide 1*b* can be constructed in a segmental manner, for example by two or more curved segments similar in construction, which curved segments can form a bending region of the strand guide 1*b*. During transport, the cast strand S is cooled actively or passively, for example by splash water, causing it to solidify gradually from the outside to the inside.

The bending region of the continuous casting apparatus 1 is followed by a straightening region, in which the cast strand S is brought into horizontal alignment. Rollers 1*c* are also provided here for guiding and transporting the casting strand S. One or more of the rollers 1*c* are drive rollers and drive the casting strand S forward in the transport direction T; other rollers 1*c* serve to guide and align the casting strand S. In this respect, the rollers 1*c* form means for driving and bending the casting strand S.

The apparatus 100 further comprises a cutting device 4, which is arranged in or behind the continuous casting apparatus 1 in the transport direction T, in particular behind the straightening region of the continuous casting apparatus 1. The cutting device 4 is used to cut or divide, as the case may be, the cast strand S into slabs 3. The cut is made along the slab thickness. "Slab thickness" is the dimension of the slab that is perpendicular to the extension of length and perpendicular to the width (in FIG. 1, perpendicular to the paper plane) of the slab. Thereby, the cutting device 4 is designed to cut the casting strand S during conveying, that is, during the movement of the casting strand S along the conveying direction T. Preferably, the cutting device 4 is a shear, in particular a pendulum shear. In this case, the shear is designed to track the transport movement of the casting strand S during the cutting operation, and one or more cutting blades cut the strand in a movement vertical to the casting strand S only.

Upstream or downstream of the cutting device 4, a decoupler 5 can be provided, for example in the form of a cold strand rocker, which is designed to be able to decouple the casting strand S from the process line if necessary, for example when starting up the plant.

Behind the cutting device 4, a preferably automated decision is made as to which route the slab 3 will take in the further course, wherein at least two routes R1 and R2 are implemented. Thus, the process line has a branching after the cutting device 4. It should be noted that the arrows R1 and R2 in FIG. 1 only schematically indicate the different routes and do not necessarily reflect the actual transport path of the slabs 3.

In the present exemplary embodiment, the first route R1, also referred to herein as the "immediate processing path," takes the slab 3 as quickly as possible after it has been cut by the cutting device 4 into a furnace 2, which brings the slab 3 to forming temperature. The second route R2, also referred to herein as the "storage path," transports the slab 3 to a slab storage facility 11. However, the routes R1 and R2 shown in FIG. 1 are only exemplary.

Process control, including possible decision criteria for individual processing of the slab 3, is detailed below. First, the further structure of the apparatus 100 in accordance with the exemplary embodiment of FIG. 1 shall be explained:

In the case of the immediate processing path, the cut slabs 3 are fed to a furnace 2 via a roller table 19. The furnace 2 is arranged behind the cutting device 4, when viewed in the transport direction T, and is designed to heat the slabs 3 to a forming temperature, preferably in the range of 1,000° C. to 1,300° C.

The furnace 2 is located as close as possible behind the cutting device 4, in order to minimize the cooling of the slabs 3, by which the immediate processing path enables a particularly energy-efficient further processing of the slabs 3.

The furnace 2 is preferably a walking beam furnace, in which the slabs 3 are moved in a walking direction during heating. For this purpose, the walking beam furnace has fixed beams and walking beams, a walking drive and heating means, which are not described in detail herein. However, the furnace 2 can also be constructed in other manners, such as a horizontal continuous furnace, a tunnel furnace, a furnace with a chain and the like.

In the present process line, a forming unit, preferably a rolling mill 12, is connected to furnace 2 when viewed in the transport direction T.

The rolling mill 12 comprises one or more rolling stands 13 and can be operated in reversing or tandem mode. However, the structure of the forming unit is not limited to the example shown in FIG. 1. For example, a combination of optionally reversing roughing stands and a finishing line with intermediate heating and/or cooling apparatuses 6 can be implemented. The forming unit or rolling mill 12, as the case may be, can have one or more descaling devices 16 that are arranged in front of or behind one or more rolling stands 13, depending on the configuration. The forming unit can be followed by a cooling section 14 and/or a discharge device 15, for example one or more coiling units.

Furthermore, the forming unit can be equipped with one or more inspection systems 21 for automatic inspection of the semi-finished product, for example with regard to surface condition, microstructure and the like.

Preferably, the forming unit comprises a welding device 22 for welding together individual workpieces, such as slabs 3 or intermediate strips, whereby forming can be performed on a continuous workpiece. For example, in the case of a rolling mill 12, the welding device 22 can be installed before or in front of the last stand group. This allows individual, successive slabs 3 or intermediate strips, as the case may be, to be rolled endlessly. Strip rolled in this manner can, if necessary, be separated again by a high-speed shear 23 in front of a coiling device.

The structure of the apparatus 100 set forth herein allows for a shortening of the cooling section between the one or more continuous casting apparatuses 1 and the furnace 2 along the immediate processing path. Conventional apparatuses such as flame cutting device(s), deburring device(s), marking machine(s), a slab storage facility and the like in front of furnace 2 can be omitted along this route, and in the simplest case these are replaced by the cutting device 4. Thus, the path of the slabs 3 produced by the cutting device 4 via the roller table 19 to the furnace 2 is considerably shortened. In the case of a slab length of, for example, 16 m, the cooling section can be shortened to a length of approximately 21 m.

In this manner, the temperature required for hot forming the slabs 3 is achieved with less heat loss. Furthermore, the mechanical removal of the burr and the equipment required for this are no longer necessary. Any slab storage facility 11 with marking machine(s) can be omitted on this route or at least reduced in size overall in the plant, since essential reasons for its use become obsolete.

The slabs 3 are inserted into the furnace 2 at a comparatively high temperature of 600° C. or more, preferably 850° C. or more, which allows the furnace 2 and thus the plant as a whole to be designed to be more compact and to conserve resources, in particular to save energy. This leads to resource-saving and cost-effective production of metallurgical semi-finished products, in particular peritectically transforming or crack-critical steel grades, microalloyed steel grades, steel grades for pipeline production and steel grades with high surface quality requirements.

To support the technical effects specified above, one or more heating apparatuses 6, preferably inductive, using gas burners or operating electrically, can be installed at different positions in the process line. Preferably, one or more heating apparatuses 6 are located substantially directly upstream of the cutting device 4 or decoupler 5, if present, and/or downstream of the cutting device 4. On the one hand, heating apparatuses 6 of this type can help to shorten the cooling section, and, on the other hand, they simplify slab storage logistics.

In the process region between the continuous casting apparatus 1 and the furnace 2, one or more inspection systems 7 can be installed to check the slab quality, for example the surfaces of the slabs 3. The inspection systems 7 are connected to process control systems 8 in the network and can make decisions on further processing and process route, or support them with information.

In the present exemplary embodiment, the second route, the storage path, takes the slabs 3 behind the cutting device 4 to a slab storage facility 11, where they can be temporarily stored. The slab storage facility 11 can be located behind the furnace 2, such that the slabs 3 are directed past the furnace 2 via the roller table 19, allowing the subsequent slabs 3 from the continuous casting apparatus 1 to be transported unimpeded into the furnace 2, provided that an appropriate route decision is made. Alternatively, the slabs 3 can be transported in front of the furnace 2 via a branching roller table to the slab storage facility 11.

Conversely, slabs 3 can be fed into the process line from other sources, such as from the slab storage facility 11 itself or via the slab storage facility 11 from another location, via a feed-in roller table 17. Feeding into the process line leading to furnace 2 can be done in different manners. Thus, it is possible to control the supply of slabs 3 from other sources such that they are fed into gaps between slabs 3 that are in the immediate processing path. Alternatively or additionally, parallel conveying is possible, with which the slabs 3 are transported on a plurality of parallel roller tables before being inserted into the furnace 2. Parallel transport of slabs 3 through the furnace 2 can also be implemented.

If required, one or more heating devices 18 can be installed, such that slabs 3 that have undergone cooling in the slab storage facility 11 are preheated by the heating device 18 to a temperature that is suitable for subsequent introduction into the furnace 2, that is, in particular to a temperature above 600° C., preferably 850° C.

Furthermore, slabs 3, which are to be cooled and temporarily stored in the slab storage facility 11, for example, can be marked by means of a marking machine 20, which is preferably arranged downstream of the furnace 2, such that they can be identified by the operating personnel of the apparatus 100 and/or by a suitable sensor system.

By feeding the slabs 3 into the common process line leading into the furnace 2 after passing through different routes, the furnace 2 and the forming unit 12 can be operated independently of the specific path that was previously taken by the respective slab 3. The forming unit 12 can operate continuously without "knowing" where the slabs 3 are coming from. A control engineering coupling between the different plant components is not necessary in this respect, or can be kept simple, such that the retrofitting of existing plants is possible without a complete new design.

Furthermore, by suitable planning or control of the process, as the case may be, a continuous casting and rolling operation or at least a continuous rolling operation can be maintained at any time in order to utilize the apparatus 100 in the best possible and energy-saving manner in terms of maximum production. This also includes the fact that, in the event of a planned or unplanned stoppage of the continuous casting apparatus 1, slabs 3 can be fed to the furnace 2 from the slab storage facility 11 or from an external source cold or, if necessary, with preheating in a further heating device included in the apparatus 100 and subsequently rolled, thus ensuring the best possible utilization of the forming unit 12 even in the event of a casting stoppage.

The apparatus 100 has one or more process control systems 8 that are responsible for process control. The monitoring and planning of the overall process can be taken over by a process planning system 9, such that so-called "Level 1," "Level 2" and "Level 3" systems can be implemented in this manner. The process control systems 8 are communicatively connected to sensors, actuators, storage media and the like, as shown by corresponding lines in FIG. 1. Communication can be wireless or wired.

The process control systems 8 are networked with each other and/or with the process planning system 9 ("Level 3") by means of a network 10, for example, for controlling the molten steel production, continuous casting apparatus 1, slab logistics, upstream heating device 18, furnace 2, forming unit (such as rolling mill 12 and cooling section) and/or the conveying devices for transporting the slabs 3, plates and/or strips. The process planning and process control can optionally be provided with automation across process stages, for example to reduce energy consumption while at the same time optimizing process control in terms of technology and energy, and/or to minimize the throughput time of the products and/or to improve product quality.

Detected data and/or data obtained by processing/calculation from the process or from the products can be stored, for example on data carriers, in databases or network storage (cloud), and used by systems 8, 9 for process optimization and performance enhancement.

In accordance with a preferred exemplary embodiment, one of the process control systems 8 is an electronic warehouse management system 8', which is designed to automatically record measured or calculated process parameters of the slabs 3 of the slab storage facility 11, for example their positions along with process parameters and quality characteristics. The recorded measured or calculated process parameters can be processed for various purposes, for example to automatically identify a suitable slab 3 according to the specifications of a process planning system 9 and to feed it to the process line at a suitable point.

At least one process control system 8 is designed to decide for each slab 3 which route—the immediate processing path or the storage path in the present exemplary embodiment—it will take. The decision is preferably made directly behind the cutting device 4, wherein the immediate processing path can be assumed as the rule.

Measured or calculated process parameters on which the decision can be based include, for example: Temperature of the slab and/or cooling curve during primary and secondary cooling in the continuous casting apparatus 1 and/or steel grade and/or quality requirement and/or planned end use.

Suitable inspection systems 7, such as temperature sensors, cameras, or other sensors, can be installed at one or more locations along the process path in order to record the desired process variables. Such values can also be provided online by suitable, preferably computer-based process models. In the exemplary embodiment of FIG. 1, an inspection system 7 is installed substantially directly behind the cutting device 4. Provided that the cutting device 4 has its own inspection system, for example to detect defects such as surface cracks or other defects on the slab 3, such information can of course be used for the route decision.

For the route decision, the process planning system 9 or the corresponding process control system 8, as the case may be, can take customer requests into account. Thus, a slab 3 meeting special quality requirements can be discharged to the slab storage facility 11 or for direct purchase by the customer.

Thereby, the planned end application can play a special role, for example with regard to surface quality or degrees of forming for the deep drawing of sheets to be produced from the corresponding slab 3. For example, particularly high demands are usually placed on surface quality for automotive outer skin. Similarly, high demands are placed on Si alloyed grades for electrical sheet production (for example, E strip with Si contents greater than 3% and Al contents greater than 0.3%).

The process outlined here with route branching enables the separate processing of slabs of different grades and quality characteristics, in particular surface qualities, in an automated manner at an early stage.

To the extent applicable, any of the individual features shown in the exemplary embodiments may be combined and/or interchanged.

LIST OF REFERENCE SIGNS

100 Apparatus for the production and further processing of slabs
1 Continuous casting apparatus
1*a* Ingot mold
1*b* Strand guide
1*c* Roller
2 Furnace
3 Medium slab
4 Cutting device
5 Decoupler
6 Heating apparatus
7 Inspection system
8 Process control system
8' Warehouse management system
9 Process planning system
10 Network
11 Slab storage facility
12 Rolling mill
13 Rolling stand
14 Cooling section
15 Discharge device
16 Descaling device
17 Feed-in roller table
18 Heating device
19 Roller table
20 Marking machine
21 Inspection system
22 Welding device
23 High-speed shear
S Casting strand
T Transport direction
R1 First route
R2 Second route

The invention claimed is:

1. An apparatus (100) for producing and further processing of slabs (3) of a metal, comprising:

a continuous casting apparatus (1), which is designed to produce a cast strand(S) and to transport it in a transport direction (T);

a cutting device (4), which is arranged behind the continuous casting apparatus (1), as seen in the transport direction (T), and is designed to cut the cast strand (S) into slabs (3);

a walking-beam furnace (2) which is arranged behind the cutting device (4), as seen in the transport direction (T), and which is configured to heat the slabs (3) to a forming temperature that is suitable for forming the slabs (3) in a rolling mill (12);

a slab storage facility (11);

a heating device (18) for preheating the slabs (3) that have undergone cooling in the slab storage facility (11);

a first route (R1) and a second route (R2) implementing, at least in some portions, different process lines for the further processing of the slabs (3); and a process control system (8), which is designed to make a route decision individually for each slab, which route decision assigns a corresponding slab (3) to the first route (R1) or to the second route (R2), and to initiate further processing of the corresponding slab (3) along the assigned route (R1, R2), wherein the first route (R1) is configured to insert the corresponding slab (3) into the furnace (2) substantially directly after cutting by the cutting device (4) such that the corresponding slab (3) is inserted into the furnace (2) with a surface temperature of 600° C. or more, wherein the second route (R2) is configured to feed the corresponding slab (3) to the slab storage facility (11) for intermediate storage after cutting by the cutting device (4), to preheat the corresponding slab (3) that has undergone cooling in the slab storage facility (11) to a temperature of 600° C. or more, and to discharge the corresponding slabs (3) in front of the furnace (2), and wherein the process control system (8) is designed to make the route decision for the slab (3) based on a planned end use of the slab (3).

2. The apparatus (100) according to claim 1, wherein the forming temperature is in a range from 1,000° C. to 1,300° C.

3. The apparatus (100) according to claim 2, wherein the process control system (8) is configured to assign the corresponding slab (3) to the first route (R1) if the surface temperature is 850° C. or more.

4. The apparatus (100) according to claim 3, wherein no deburring device is provided on the first route (R1) between the cutting device (4) and the furnace (2).

5. The apparatus (100) according to claim 2, wherein the process control system (8) is configured to assign the corresponding slab (3) to the second route (R2) if the surface temperature is less than 850° C.

6. The apparatus (100) according to claim 2, further comprising a rolling mill (12) with one or more rolling stands (13), which is arranged behind the furnace (2) when viewed in the transport direction (T).

7. The apparatus (100) according to claim 2, further comprising a forming unit which is arranged behind the furnace (2) when viewed in the transport direction (T), wherein the forming unit comprises one or more descaling devices (16) and/or one or more heating apparatuses (6) and/or one or more inspection systems (21) and/or a welding device (22) for welding together successive slabs (3) or intermediate strips.

8. The apparatus (100) according to claim 1, wherein the heating device (18) is designed to preheat slabs (3) that have undergone cooling in the slab storage facility (11) to a temperature of 850° C. or more.

9. The apparatus (100) according to claim 1, wherein the process control system (8) is designed to make the route decision for the slab (3) taking into account measured or calculated surface temperature and a steel grade of the slab (3).

10. The apparatus (100) according to claim 1, wherein the cutting device (4) comprises an inspection system (7) or an inspection system (7) is arranged substantially directly behind the cutting device (4) and is communicatively coupled to and designed with the process control system (8), in order to detect one or more physical quantities of the slabs (3) and transmit them to the process control system (8), wherein the process control system (8) is designed to use data received from the inspection system (7) for the route decision.

11. The apparatus (100) according to claim 1, wherein one or more heating apparatuses (6) are arranged upstream of the cutting device (4) or of a decoupler (5) and/or downstream of the cutting device (4), wherein the heating apparatuses (6) are implemented inductively, with gas burners or electrically.

12. The apparatus (100) according to claim 1, wherein the apparatus is designed for producing and further processing of medium slabs (3) with a slab thickness in a range of 140 to 200 mm.

13. The apparatus (100) according to claim 1, wherein the continuous casting apparatus (1) comprises an ingot mold (la) that is designed to receive molten metal and discharge the cast strand(S) downwardly, wherein the ingot mold (1*c*) comprises two facing plane-parallel plates that define a thickness of the cast strand in a range of 140 to 200 mm.

14. The apparatus (100) according to claim 1, wherein the cutting device (4) comprises pendulum shears.

15. The apparatus (100) according to claim 1, wherein the route decision is a function of a measured or calculated surface temperature and a silicon content of the corresponding slab (3).

* * * * *